US006418665B1

(12) United States Patent
Gabriele

(10) Patent No.: US 6,418,665 B1
(45) Date of Patent: Jul. 16, 2002

(54) LOUVER CONTROL BAR WITH BENDABLE LOUVER ATTACHMENT MEMBERS

(75) Inventor: Angelo Gabriele, Concord (CA)

(73) Assignee: Vinylbilt Shutter Systems Inc., Concord ( * ) Notice: Subject to any disclaimer, the term of this patent is extended or adjusted under 35 U.S.C. 154(b) by 0 days.

(21) Appl. No.: 09/881,035

(22) Filed: Jun. 15, 2001

(30) Foreign Application Priority Data

Jun. 14, 2001 (CA) ..... 2350537

(51) Int. Cl.[7] ..... E06B 7/086
(52) U.S. Cl. ..... 49/87.1
(58) Field of Search ..... 49/74.1, 87.1, 49/73

(56) References Cited

U.S. PATENT DOCUMENTS 5,187,896 A * 2/1993 Ross ..... 48/87.1
5,548,925 A * 8/1996 Marocco ..... 49/87.1
5,778,598 A * 7/1998 Ohanesian ..... 49/87.1
6,250,012 B1 * 6/2001 Ricci ..... 49/87.1

* cited by examiner

*Primary Examiner*—Jerry Redman

(57) ABSTRACT

A shutter louver control bar which is made from a resilient plastic material includes an elongated bar member with a plurality of louver attachment members spaced from one another lengthwise along the bar member. Each attachment member, which normally assumes a louver attachment position, and which is moveable to a louver insertion position, has a leg with base leg part extending from the bar member, an outer leg part extending from and aligned with the base leg part and a head portion transverse to both the outer leg part and the base leg part when the attachment member is in the louver attachment position. The outer leg part is more flexible than and bendable relative to the base leg part which enables the attachment member to be moved to the louver insertion position where the head portion of the attachment member is at least somewhat generally aligned with the base part while remaining at generally transverse of the outer leg part of the attachment member. The plastic material of the attachment member has sufficient memory to cause the outer leg part to realign with the base leg part in moving the attachment member away from the louver insertion position back to the louver attachment position.

3 Claims, 3 Drawing Sheets

5
6

9
7
13
11
13

LOUVER CONTROL BAR WITH BENDABLE LOUVER ATTACHMENT MEMBERS

FIELD OF THE INVENTION

The present invention relates to a louver control bar for use in a moveable louver shutter.

BACKGROUND OF THE INVENTION

For many years moveable louver shutters have included a one-piece control bar with attachment means for attaching the bar to the outer edge of each louver in the shutter. This control bar is typically located centrally of the shutter.

Prior to the advent of modern plastic shutters this louver control bar was attached by metal staples to the louvers of a wooden shutter.

In the case of the more recent plastic shutters the attachment is made by something other than a metal staple. One example of the attachment between a control bar and louver in a plastic shutter comprises a louver having a receiving opening and the attachment member on the control bar comprises a T-shaped member. The arms of the head of the T-shaped member are bent to a position for insertion within the recess in the louver. The plastic material of the attachment member then causes these arms to move to a louver attachment position within the louver.

In theory the Ross construction is good, however, in practice problems arise because the relatively small and fragile head portion of the attachment member will often break while being bent to the louver insertion position. When this happens the attachment member is not able to return to the louver attachment position and will not make a positive engagement with the louver.

SUMMARY OF THE PRESENT INVENTION

The present invention relates to a shutter louver control bar construction which is just as easily fitted into a plastic louver as what has been used in the past without suffering from the same damage problems.

More specifically, the shutter louver control bar of the present invention which is made from a resilient we plastic material comprises an elongated bar member having a plurality of louver attachment members spaced from one another lengthwise along the bar member. Each attachment member, which normally assumes a louver attachment position, and which is moveable to a louver insertion position, comprises a leg having a base part extending from the bar member, and also having an outer leg part continuing from and aligned with the base leg part. The attachment member further has a head portion transverse to both the outer leg part and the base leg part when the attachment member is in the louver attachment position.

The outer leg part of the attachment member is more flexible than and bendable relative to the base leg part to move the attachment member to the louver insertion position where the head portion is at least somewhat generally aligned with the base leg part while remaining generally transverse of the outer leg part of the attachment member. The plastic material then has sufficient memory to cause the outer leg part to realign with the base leg part in moving the attachment member back to the louver attachment position.

As a result of the above construction, the bending occurs in the outer leg part of the attachment member which is much stronger and more resistant to breakage than the head portion of the attachment member.

BRIEF DESCRIPTION OF THE DRAWINGS

The above as well as other advantages and features of the present invention will be described in greater detail according to the preferred embodiments of the present invention in which.

DETAILED DESCRIPTION ACCORDING TO THE PREFERRED EMBODIMENTS OF THE PRESENT INVENTION IN WHICH

Figure 1:
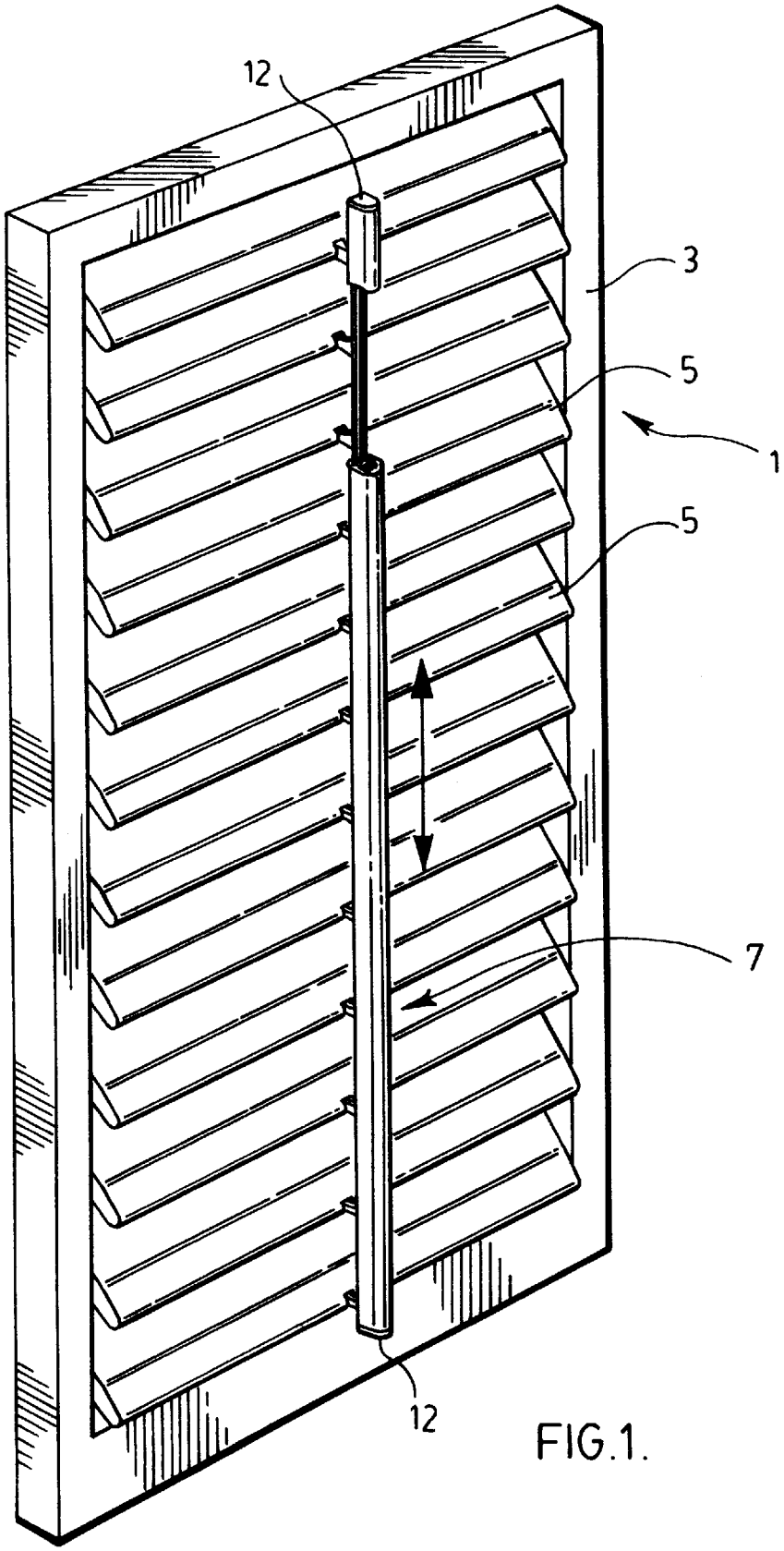
FIG. 1 is a perspective view a plastic shutter with moveable louvers and a control bar attached to those moveable louvers in accordance with a preferred embodiment of the present invention.

FIG. 1 shows a plastic shutter generally indicated at 1. The plastic material used in making the shutter e.g., PVC or the like, is one which is extremely durable and essentially maintenance free.

The shutter itself comprises a supporting frame 3 and a plurality of louvers 5 pivotally secured within the frame. These louvers are moved in unison with one another by means of a control bar generally indicated at 7.

Figure 2:
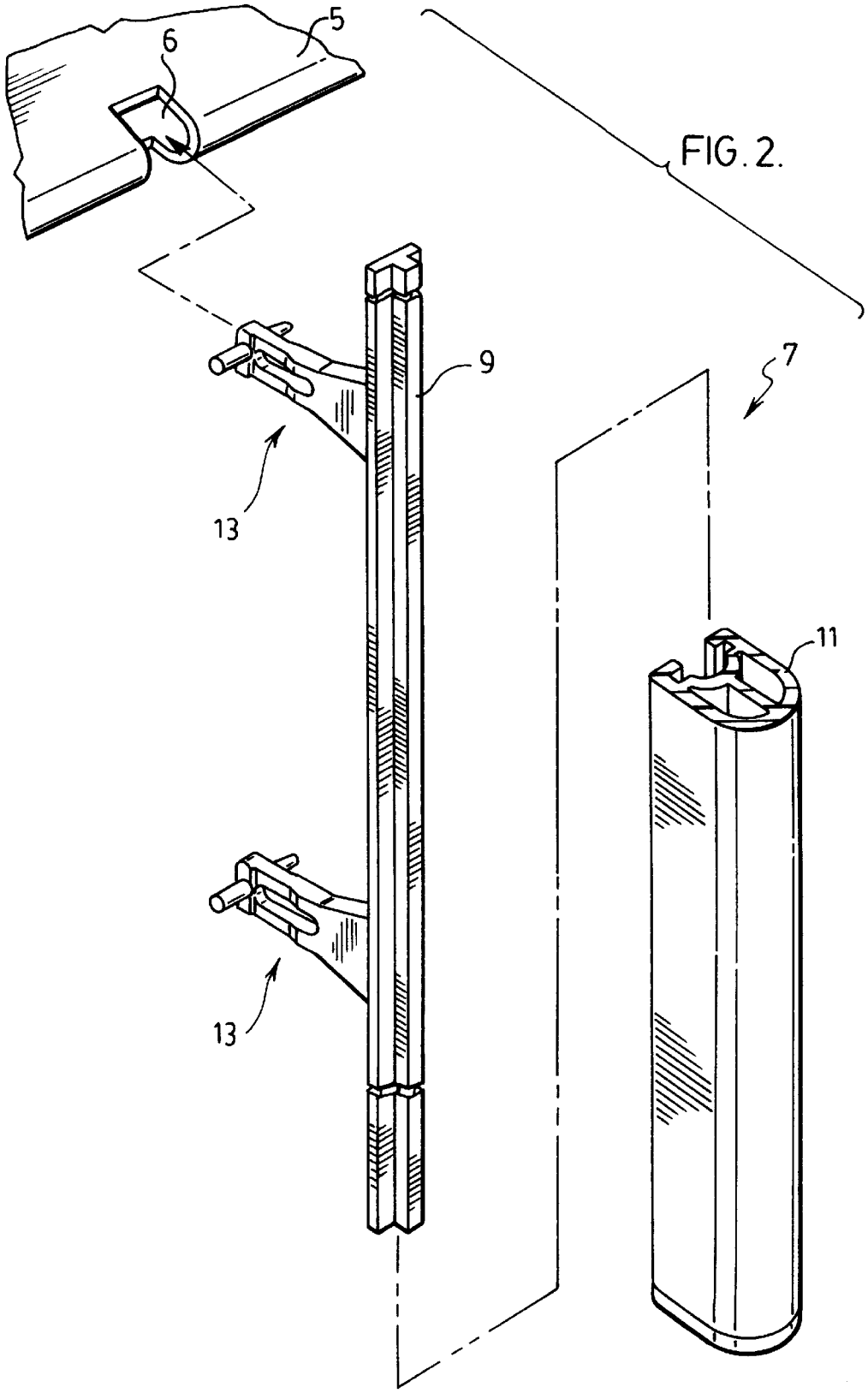
FIG. 2 is an exploded perspective view of the control bar ready for attachment to one of the louvers from the shutter of FIG. 1.

Control bar 7 which is better seen in FIG. 2 of the drawings comprises an elongated bar member 9 and a cover 11 which sleeves over bar 9. The cover includes end caps 12 seen in FIG. 1 of the drawings which give it a completed appearance after sleeving over bar 9.

Bar 9 is provided with a plurality of louver attachment members generally indicated at 13 spaced from one anther along the bar. Each louver 5 has a hollow construction and is provided with a small recess 6 for receiving its respective attachment member of the control bar.

Figure 3:
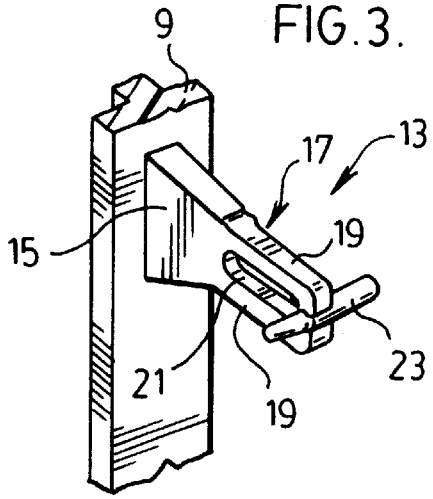
FIG. 3 is an enlarged perspective view of one of the attachment members from the control bar of FIG. 2.
Figure 4:
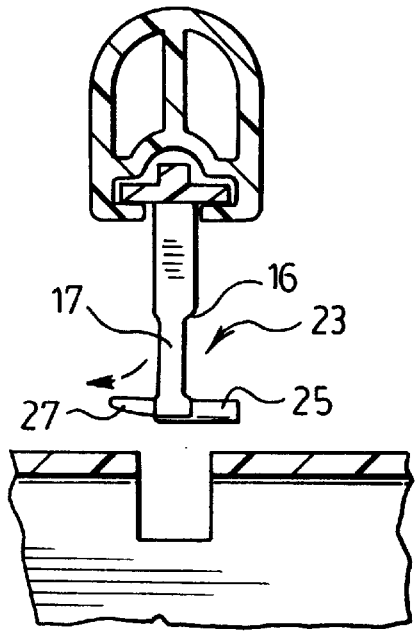
FIGS. 4 through 6 are sectional views through the control bar showing the steps taken to insert the attachment member within one of the louvers of the shutter of FIG. 1.
Figure 5:
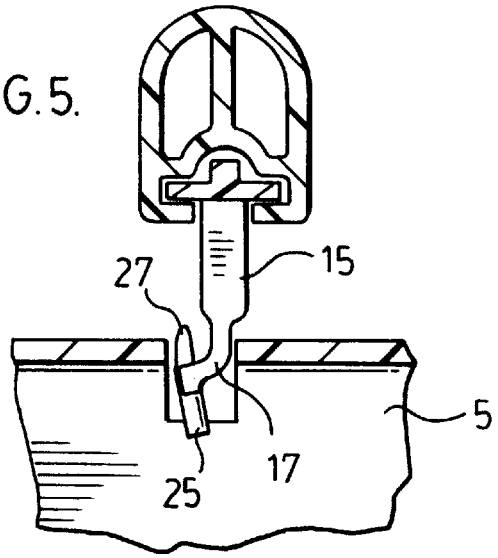
Figure 6:
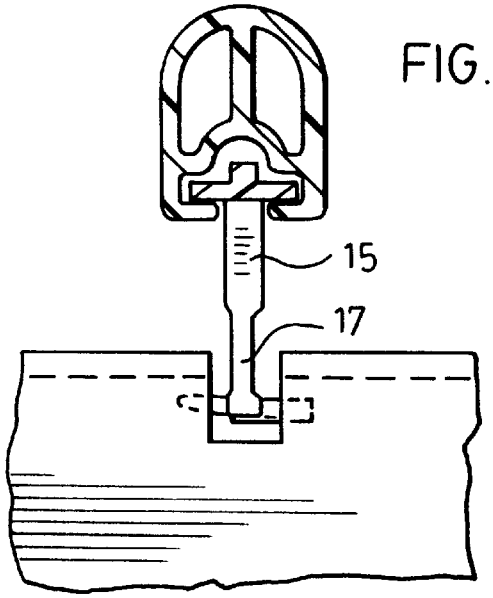

Referring now to FIGS. 3 through 6 each attachment member 13 comprises a leg generally indicated at 14 having base leg part 15 and an outer leg part 17 which comprises an aligned extension of the base leg part. However, as can be seen in FIGS. 4 through 6 of the drawings the outer leg part 17 is substantially reduced in material thickness relative to the base leg part 15 of the attachment member. Furthermore, as shown in FIG. 3 the outer leg part 17 comprises a pair of arm members 19 separated from one another by a spacing 21. As a result, the outer part of the attachment member is much more flexible than the base leg part of the attachment member.

Each attachment member is completed with a head portion generally indicated at 23. This head portion extends transversely of both the outer leg part and the base leg part of the attachment member when the attachment member is in its normal position of FIG. 3. This normal position as shown for example in FIG. 6 of the drawings is the louver attachment position.

The head portion 23 which is trapped between the two arms 19 in the spacing 21 of the outer leg part 17 of the attachment member has first and second ends 25 and 27 respectively to opposite sides of the outer part of leg 14. End 25 is longer than and much more squared off relative to end 27. End 27 on the other hand is shorter and has a cam shaping.

In order to fit each attachment member with its respective louver the attachment member is bent at the outer leg part of the attachment member to place the head portion such that it is generally aligned with the base leg part of the attachment member as shown in FIG. 5 of the drawings. Here it should be noted that the head portion 25 still remains at least generally transverse of the outer leg part 17 of the attachment member. Accordingly, the bending occurs within the outer leg part of the attachment member and not between the head portion and the outer part of the attachment member.

FIG. 4 of the drawings shows that the attachment member is generally flat between the base and the outer leg parts along one side of the attachment member. However, towards the other side of the attachment member there a substantial shoulder generally indicated at 16 between the base and outer leg parts of the attachment member. This shoulder or shaping of the attachment member promotes bending of the outer leg part 17 in a direction such that the shorter end 27 of the head portion moves closer to the base leg part 15 while the longer end 25 is moved farther from the base leg part 15 of the attachment member. In this position the longer end 25 of the head portion is first inserted into the louver recess 6 with the shorter end 27 only fitting into the recess after the memory of the plastic material returns the attachment member back to the FIG. 6 louver attachment position. The cam shaping of the head portion end 27 easily allows it to clear the edge surface of the louver and to move internally of the louver.

It will be seen from the above how the insertion of the attachment member is extremely simple and efficient by not stressing the head portion of the attachment member but rather by relying on the resiliency of the much stronger arms 19 of the outer leg part of the attachment member to move to and from the louver insertion position.

Although various preferred embodiments of the present invention have been described in detail, it will be appreciated by those skilled in the art that variations may be made without departing from the spirit of the invention or the scope of the appended claims.

The embodiments of the invention in which an exclusive property or privilege is claimed are defined as follows:

1. A shutter louver control bar construction which is made from a resilient plastic material, said control bar construction including an elongated bar member having a plurality of louver attachment members spaced from one another lengthwise along said bar member, each said attachment member, which normally assumes a louver attachment position and which is moveable to a louver insertion position, comprising a leg having a base leg part extending from said bar member, an outer leg part extending from and aligned with said base leg part and a head portion attached to said outer leg part, said head portion being transverse to both said outer leg part and said base leg part when said attachment member is in the louver attachment position, said leg having an inwardly directed shoulder which reduces material thickness of said leg between said base leg part and said outer leg part making said outer leg part more flexible than and bendable relative to said base leg part, said outer leg part being widened where said head portion is attached to said outer leg part such that said leg bends at said outer leg part and said head portion remains transverse to said outer leg part when said attachment member is moved to the louver insertion position, said plastic material having sufficient memory to cause said outer leg part to bend back and realign with said base leg part in moving said attachment member away from the louver insertion position back to the louver attachment position.

2. A control bar construction as claimed in claim 1 wherein said head portion has first and second ends to opposite sides of said outer leg part of said leg of said attachment member, said first end being shorter than said second end of said head portion, said inwardly directed shoulder and said second end of said head portion being on the same side of said attachment member which promotes bending of said outer leg part to the louver position in a direction which moves said head portion away from its position transverse of and to a position more aligned with the base part of said leg in which said first end of said head portion is closer to and second end of said head portion is farther from said base leg part of said leg of said attachment member.

3. A control bar construction as claimed in claim 1 wherein said first end of said head portion has a cam shape.

* * * * *